US009863087B2

(12) United States Patent
Lee et al.

(10) Patent No.: US 9,863,087 B2
(45) Date of Patent: Jan. 9, 2018

(54) WASHING MACHINE AND METHOD OF CONTROLLING THE SAME

(71) Applicant: LG ELECTRONICS INC., Seoul (KR)

(72) Inventors: Sangwoo Lee, Seoul (KR); Youngho Kim, Seoul (KR)

(73) Assignee: LG ELECTRONICS, Seoul (KR)

( * ) Notice: Subject to any disclaimer, the term of this patent is extended or adjusted under 35 U.S.C. 154(b) by 170 days.

(21) Appl. No.: 14/606,539

(22) Filed: Jan. 27, 2015

(65) Prior Publication Data

US 2015/0211173 A1 Jul. 30, 2015

(30) Foreign Application Priority Data

Jan. 28, 2014 (KR) ..... 10-2014-0010754

(51) Int. Cl.

| | |
|---|---|
| ***D06F 29/00*** | (2006.01) |
| ***D06F 39/00*** | (2006.01) |
| ***D06F 57/00*** | (2006.01) |
| ***D06F 73/00*** | (2006.01) |
| ***D06F 73/02*** | (2006.01) |

(52) U.S. Cl.

CPC ..... *D06F 73/02* (2013.01); *D06F 29/00* (2013.01); *D06F 39/008* (2013.01); *D06F 57/00* (2013.01); *D06F 73/00* (2013.01)

(58) Field of Classification Search

CPC ..... D06F 29/00; D06F 39/008; D06F 57/00; D06F 73/00; D06F 73/02

USPC ..... 8/158, 159; 68/5 C, 222, 240

See application file for complete search history.

(56) References Cited

U.S. PATENT DOCUMENTS

2006/0016020 A1* 1/2006 Park ..... D06F 39/083 8/158

FOREIGN PATENT DOCUMENTS

| | | | |
|---|---|---|---|
| CN | 1580359 | A | 2/2005 |
| CN | 1880541 | A | 12/2006 |
| CN | 102899850 | A | 1/2013 |
| JP | 01-146588 | A | 6/1989 |
| JP | 2011-24990 | A | 2/2011 |
| JP | 2013-027416 | A | 2/2013 |

OTHER PUBLICATIONS

Tobi et al., "JP 2011024990 A English Machine Translation.pdf", Feb. 10, 2011—Machine translation from Espacenet.com.*

* cited by examiner

*Primary Examiner* — Levon J Shahinian
(74) *Attorney, Agent, or Firm* — Dentons US LLP

(57) ABSTRACT

A washing machine including an inner tub for receiving clothes, an outer tub accommodating the inner tub, a motor for supplying rotational force to rotate the inner tub, and a hanger unit detachably coupled to an upper end of the outer tub and from which clothes are hung, whereby wrinkles of the clothes hung from the hanger unit are reduced by virtue of vibration generated during rotation of the motor. A method of controlling a washing machine including hanging clothes on a hanger unit coupled to the inner tub, rotating the inner tub at a first lower rotational speed, and rotating the inner tub at a second rotational speed higher than the first lower rotational speed.

6 Claims, 11 Drawing Sheets

WASHING MACHINE AND METHOD OF CONTROLLING THE SAME

CROSS-REFERENCE TO RELATED APPLICATION

Pursuant to 35 U.S.C. §119(a), this application claims the priority benefit of Korean Patent Application No. 10-2014-0010754, filed on Jan. 28, 2014 in the Korean Intellectual Property Office, the contents of which is incorporated herein by reference in its entirety.

BACKGROUND

1. Field

The present disclosure relates to a washing machine and a method of controlling the same, and more particularly to a washing machine and a method of controlling the same, which are capable of reducing the occurrence of wrinkles in clothes.

2. Description of the Related Art

Washing machines generally refer to various apparatuses which are constructed to apply physical actions and/or chemical actions to clothes such as clothing and bedclothes (hereinafter referred to as "clothes") in order to treat the clothes. Such a washing machine typically includes an outer tub for receiving washing water, and an inner tub rotatably installed in the outer tub to receive clothes.

Generally, washing machines perform washing and drying operations. However, wrinkles may be generated in clothes during these operations.

Although a method of spraying steam to reduce wrinkles of clothes may be used, it may be difficult to achieve sufficient wrinkle reduction effects by spraying steam to clothes.

Additionally, clothes in an inner tub may become rumpled, without being maintained in a more or less unwrinkled state, and, as such, it may be impossible to obtain considerable reduction of wrinkles even though steam is sprayed to the clothes in the inner tub.

SUMMARY

Therefore, embodiments of the present invention have been made in view of the above problems. One object is to provide a washing machine which is designed to reduce wrinkles of clothes.

It should be noted that the above-noted objects is are not limiting, and other unmentioned objects will be clearly understood by those skilled in the art from the following description.

In accordance with one embodiment of the present invention, the above and other objects can be accomplished by the provision of a washing machine including an inner tub for receiving clothes, an outer tub accommodating the inner tub, a motor for supplying rotational force to rotate the inner tub, and a hanger unit detachably coupled to an upper end of the outer tub, wherein the clothes are hung from the hanger unit, and whereby wrinkles of the clothes hung from the hanger unit are reduced by virtue of vibration generated during rotation of the motor.

In accordance with another embodiment of the present invention, there is provided a washing machine including an inner tub for receiving clothes, a motor for supplying rotational force to rotate the inner tub, and a hanger unit detachably coupled to the inner tub, wherein the clothes are hung from the hanger unit, and whereby wrinkles of the clothes are reduced by virtue of rotation of the inner tub and thus rotation of the hanger unit.

In accordance with a further embodiment of the present invention, there is provided a method of controlling a washing machine including hanging the clothes on the hanger unit coupled to the inner tub, rotating the inner tub at a first lower rotational speed, and rotating the inner tub at a second rotational speed higher than the first lower rotational speed.

Other specific details of embodiments of the present invention are disclosed in the detailed description and the accompanying drawings.

BRIEF DESCRIPTION OF THE DRAWINGS

Embodiments will be described in detail with reference to the following drawings in which like reference numerals refer to like elements, and wherein.

DETAILED DESCRIPTION OF THE PREFERRED EMBODIMENTS

Figure 1:
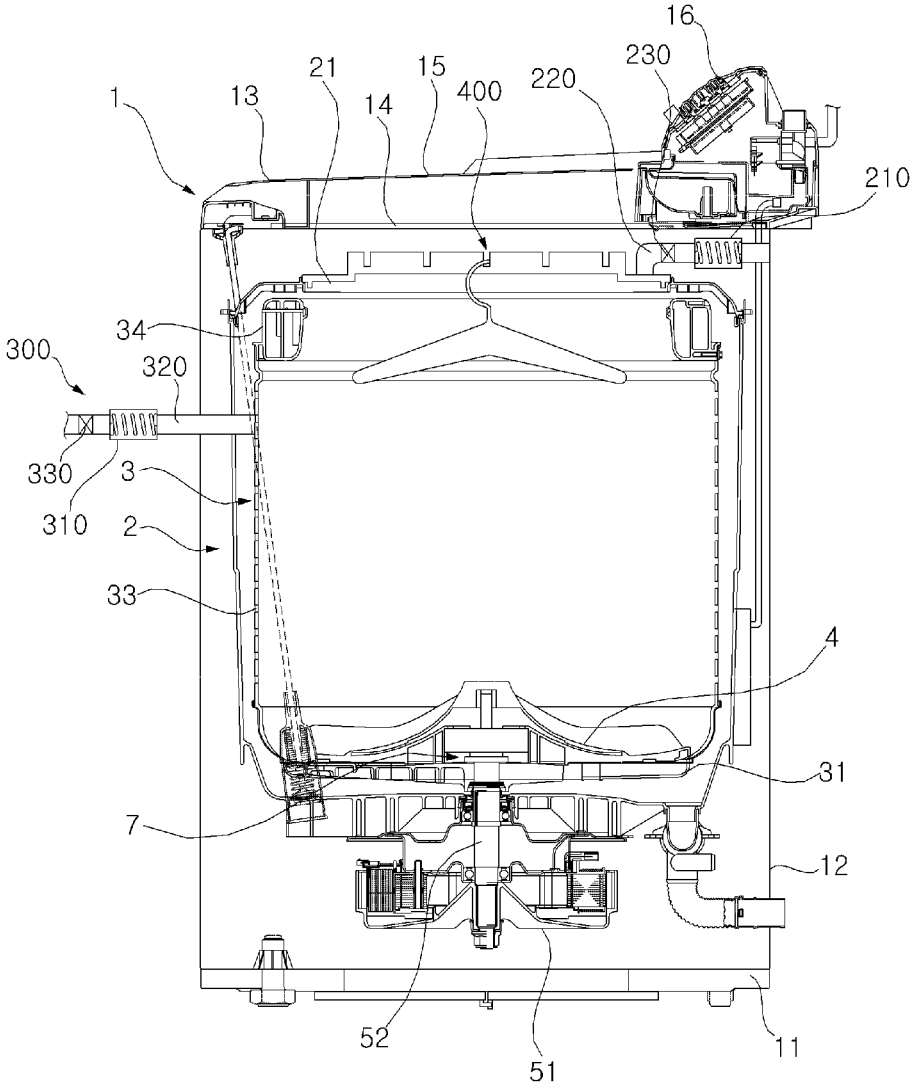
FIG. 1 is a longitudinal cross-sectional view of a washing machine according to a first embodiment of the present invention.

Advantages and features of the present invention and methods for achieving the same will become apparent upon referring to embodiments described later in detail with reference to the attached drawings. However, embodiments are not limited to the embodiments disclosed hereinafter and may be embodied in different ways. The same reference numerals may refer to the same elements throughout the specification.

Hereinafter, washing machines according to embodiments of the present invention will be described with reference to the accompanying drawings.

According to the embodiments of the present invention, since the hanger unit which can be easily coupled to the inner tub or the outer tub in a detachable manner, wrinkles of clothes can be reduced by vibration of the outer tub or rotational force of the inner tub.

Furthermore, according to the embodiments, since clothes are hung from the wing part and the lifting part and thus the lower ends of the clothes are lifted from the bottom of the inner tub by a length of a region defined by the wing part and the lifting part, effects on reduction of wrinkles in lower parts of the clothes can be improved in a wrinkle reduction mode.

In addition, according to the embodiments, in the case of clothes which have been completely washed and dehydrated, drying of the clothes and reduction of wrinkles of the clothes can be concurrently implemented by virtue of supply of hot air from the hot air supply unit, vibration of the outer tub, and rotation of the inner tub.

Furthermore, according to the embodiments, in the case of clothes which have been completely dried or have not been subjected to a washing procedure, reduction of wrinkles of the clothes by application of steam and reduction of wrinkles of the clothes by physical action such as vibration of the outer tub or rotation of the inner tub can be concurrently implemented.

In addition, according to the embodiments, since lower parts of the clothes are lifted from the bottom of the inner tub and intensive centrifugal force is applied to the clothes hung from the hanger unit by virtue of the provision of the rotation at the higher rotational speed, the clothes which have been primarily disentangled in the rotation at the lower rotational speed can be further disentangled by virtue of the intensive centrifugal force.

Figure 2:
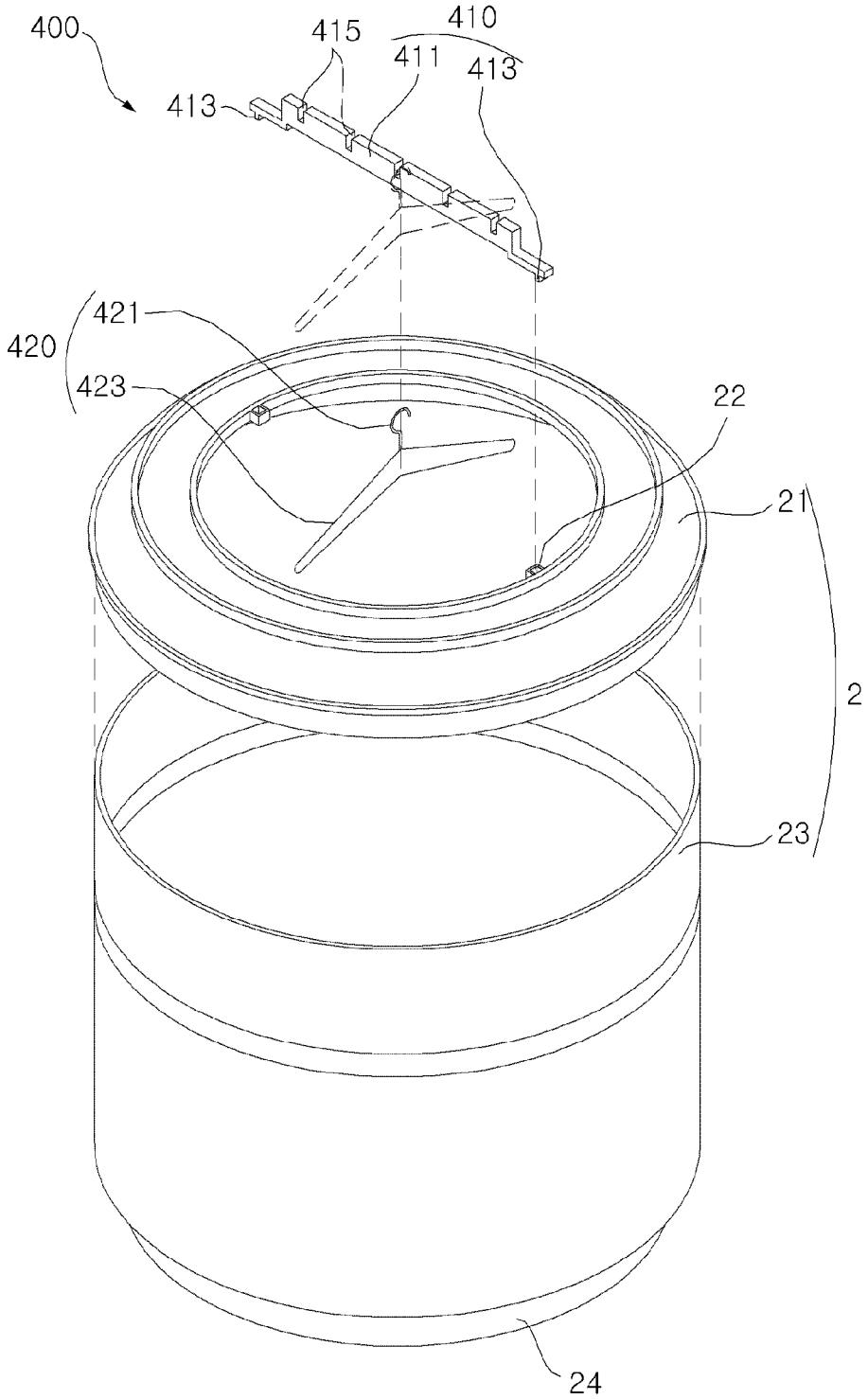
FIG. 2 is an exploded perspective view showing an outer tub and a hanger unit of FIG. 1.

FIG. 1 is a longitudinal cross-sectional view of a washing machine according to an embodiment of the present invention. FIG. 2 is an exploded perspective view showing an outer tub and a hanger unit of FIG. 1.

Referring to FIGS. 1 and 2, the washing machine according to an embodiment of the present invention includes an inner tub 3 which receives clothes, an outer tub 2 for housing inner tub 3, a motor 51 for supplying rotational force required to rotate inner tub 3, and a hanger unit 400 detachably mounted on an upper end of outer tub 2 and from which clothes are hung.

The washing machine according to this embodiment may further include a steam supply unit 200 and/or a hot air supply unit 300.

The washing machine may include, in addition to the inner tub 3, a casing 1, and a pulsator 4.

Casing 1 may define an external appearance of the washing machine. Casing 1 may include a base 11, a body 12 mounted on base 11 to define a peripheral appearance of the washing machine, and a top plate 13 installed on the body 12.

Top plate 13 may be provided with a clothes port 14 to allow clothes to be put in or taken out of the washing machine therethrough, and may be provided with a lid 15 for opening and closing the clothes port 14.

Casing 1 may be provided with a control panel 16 for controlling the washing machine. Control panel 16 may be installed at a front part or a rear part of the top plate 13.

Casing 1 may include outer tub 2 therein. Outer tub 2 may contain washing water for washing clothes.

Outer tub 2 may be provided at an upper surface thereof with an opening through which clothes may be put in or taken out of the washing machine. Outer tub 2 may be installed in casing 1 in a shock-absorbing manner by means of a damper or a hanger.

More specifically, outer tub 2 may include an outer tub base 24 constituting a bottom of the outer tub 2, and an outer tub body 23 coupled to an upper end of the outer tub base 24. Outer tub body 23 may be formed into a hollow cylindrical shape.

Outer tub body 23 has an opened upper end, and may be provided at an upper end thereof with an outer tub cover 21.

Pulsator 4 is rotatably installed at a bottom of inner tub 3. Pulsator 4 is connected to a rotating shaft 52. Outer tub 2 may be provided with a motor 51 for rotating the pulsator 4 and/or the inner tub 3.

Inner tub 3 may receive clothes. Inner tub 3 may be positioned in casing 1, and may have a smaller size than that of outer tub 2 so as to be positioned in outer tub 2. Outer tub 2 may serve as a tub containing washing water, and inner tub 3 may serve as a tub in which clothes are washed by washing water.

Inner tub 3 may include an inner tub base 31 positioned under the pulsator 4 to surround a lower part of pulsator 4 and to constitute a bottom of the inner tub 3, and an inner tub body 33 coupled to an upper end of the inner tub base 31. Inner tub body 33 may be formed into a hollow cylindrical shape. Inner tub body 33 may have a water opening through which washing water flows. Inner tub body 33 may be provided at an upper part thereof with a balancer 34.

Inner tub 3 may be opened at an upper end thereof so as to allow clothes to be introduced thereinto.

Motor 51 is capable of rotating the pulsator 4 or the inner tub 3. Furthermore, motor 51 is also capable of rotating the pulsator 4 and the inner tub 3 at the same time.

Rotational force generated from the motor 51 is transmitted via rotating shaft 52 so as to rotate the inner tub 3 and/or the pulsator 4. In order to selectively rotate the inner tub and/or the pulsator 4, the washing machine may include a clutch (not shown) functioning to selectively achieve the connection between the rotating shaft 52 and the inner tub 3 or the connection between the rotating shaft 52 and the pulsator 4. The washing machine may include a driving unit (not shown) for applying a driving signal, for controlling rotation of motor 51, to the motor 51 by control of a control unit (not shown).

Rotating shaft 52 of motor 51 is preferably positioned parallel to the direction of gravitational force.

The driving unit applies a driving signal having a predetermined pattern to motor 51 so as to rotate motor 51 in response to the driving signal.

The driving signal may have various patterns including an ON time period in which electric current is applied and an OFF time period in which electric current is not applied.

The driving unit may include a driving circuit of an electric power unit for controlling electric power, called "IPM (Intelligent Power Module)", or a power source module with self-protection function. The driving circuit may include a MOSFET (Metal-Oxide-Semiconductor Field-Effect Transistor) or IGBT (Insulated Gate Bipolar Transistor).

The control unit may operate the clutch, so that one of the inner tub 3 and the pulsator 4 may be selectively rotated, or both the inner tub 3 and the pulsator 4 may be rotated together. Although the clutch is not specifically illustrated in this embodiment, the clutch which is incorporated in conventional washing machines may be embodied as various types of clutches by those skilled in the art.

Steam supply unit 200 heats water to vaporize the water into steam, and supplies the steam into the outer tub 2.

In other words, steam supply unit 200 supplies steam to clothes hung from hanger unit 400.

For example, steam supply unit 200 may include a steam heater 210 for heating water into steam, a steam supply pipe 220 equipped with a valve 230 for supplying outer tub 2 with the steam generated from steam heater 210, and a spray nozzle for spraying the steam supplied through the steam supply pipe 220 into the outer tub 2.

Hot air supply unit 300 is configured to heat air and to supply the heated air into outer tub 2.

In other words, hot air supply unit 300 supplies the hot air to clothes hung from hanger unit 400.

For example, the hot air supply unit 300 may include an air heater 310 for heating air, a hot air supply pipe 320 for supplying the hot air generated by the air heater 310 into outer tub 2, and a blower fan 330 for blowing the hot air.

Referring to FIG. 2, hanger unit 400 functions to allow clothes to be held in a hung state in the inner tub 3 by utilizing gravity.

Considering the length of clothes, hanger unit 400 may be detachably mounted on an upper end of outer tub 2.

For example, hanger unit 400 may include a supporter 410, and a hanger 420.

Supporter 410 may be detachably coupled to coupling holes 22 formed at an upper end of outer tub 2 to support hanger 420.

Meanwhile, inner tub 3 and outer tub 2 are each formed into a hollow cylindrical shape having an axis extending in the direction of gravity, and the upper ends thereof are opened. Coupling holes 22 may be formed into a recess or through-hole shape extending in the direction of gravity.

Supporter 410 may be coupled to an upper end of outer tub 2, or may be coupled to the outer tub cover 21, as illustrated in FIG. 2.

More specifically, supporter 410 includes a center section 411 having a plurality of grooves 415 formed thereon, and coupling sections 413 connected to the opposite ends of center section 411 and fitted in the coupling holes 22.

Center section 411 serves as a beam to or from which hanger 420 is coupled or hung. The center section 411 may be positioned perpendicular to rotating shaft 52. Center section 411 may be provided with the plurality of grooves 415 in which hanger 420 is fitted and thus hung.

As mentioned above, coupling sections 413 are connected to the opposite ends of center section 411 and are fitted in the coupling holes 22. Specifically, the coupling sections 413 include protrusions, respectively, which are fitted in the coupling holes 22.

In order to hang long clothes, an upper surface of center section 411 preferably protrudes higher than upper surfaces of coupling sections 413. In particular, since the washing machine may be used with the lid 15 being opened, the upper surface of center section 411 may be positioned higher than the upper end of outer tub 2.

Hanger 420 supports clothes such that the clothes are held in a hung state in inner tub 3.

Hanger 420 may be hung from supporter 410, or may be coupled to supporter 410. For example, hanger 420 may include a hanging part 421 centrally provided thereon, and a wing part 423 from which clothes are hung.

Hanging part 421, which has a hook shape, is fitted in one of the grooves 415 formed at the center section 411.

Wing part 423 may be configured to enable clothes to be hung thereon. For example, wing part 423 may extend in a direction perpendicular to rotating shaft 52 (in a radial direction of inner tub 3). Wing part 423 from which upper parts of clothes may be hung functions to cause the clothes to be suspended in a direction of rotating shaft and to be expanded in a direction perpendicular to rotating shaft 52.

Hanging part 421 may be integrally formed with wing part 423 or may be coupled to wing part 423. Hanging part 421 and wing part 423 may be constructed to restrict relative rotation therebetween. Various examples of hanger 420 according of the present invention will now be described.

Figure 3A:
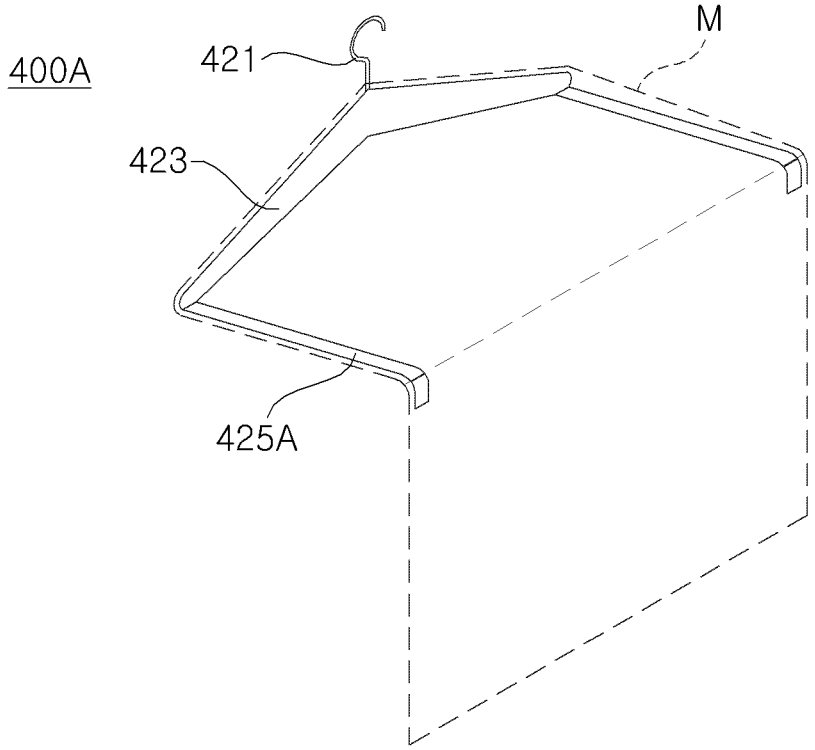
FIGS. 3A to 3C are perspective views illustrating various examples of a hanger unit of the present invention.
Figure 3B:
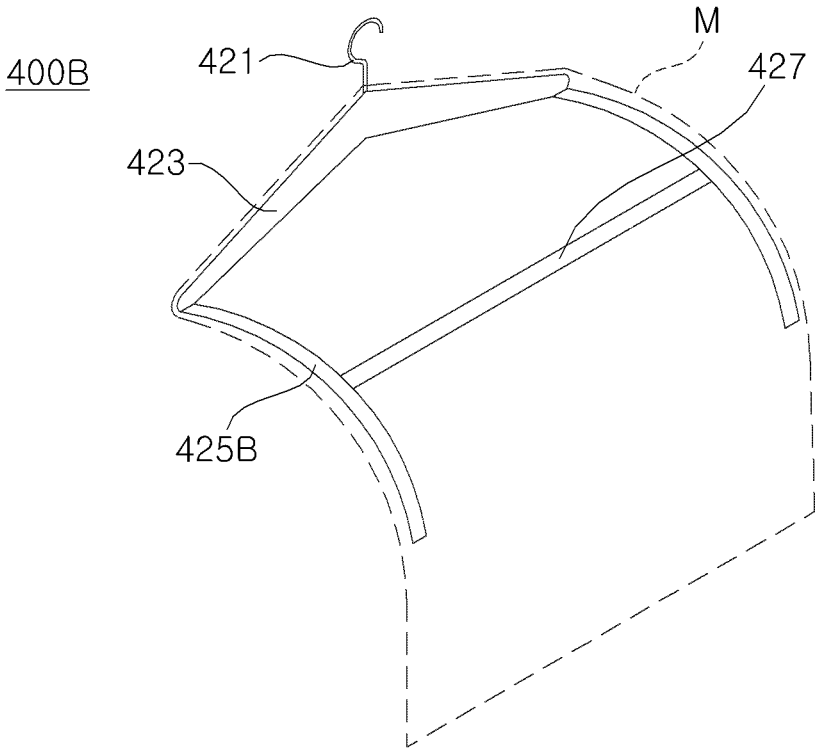
Figure 3C:
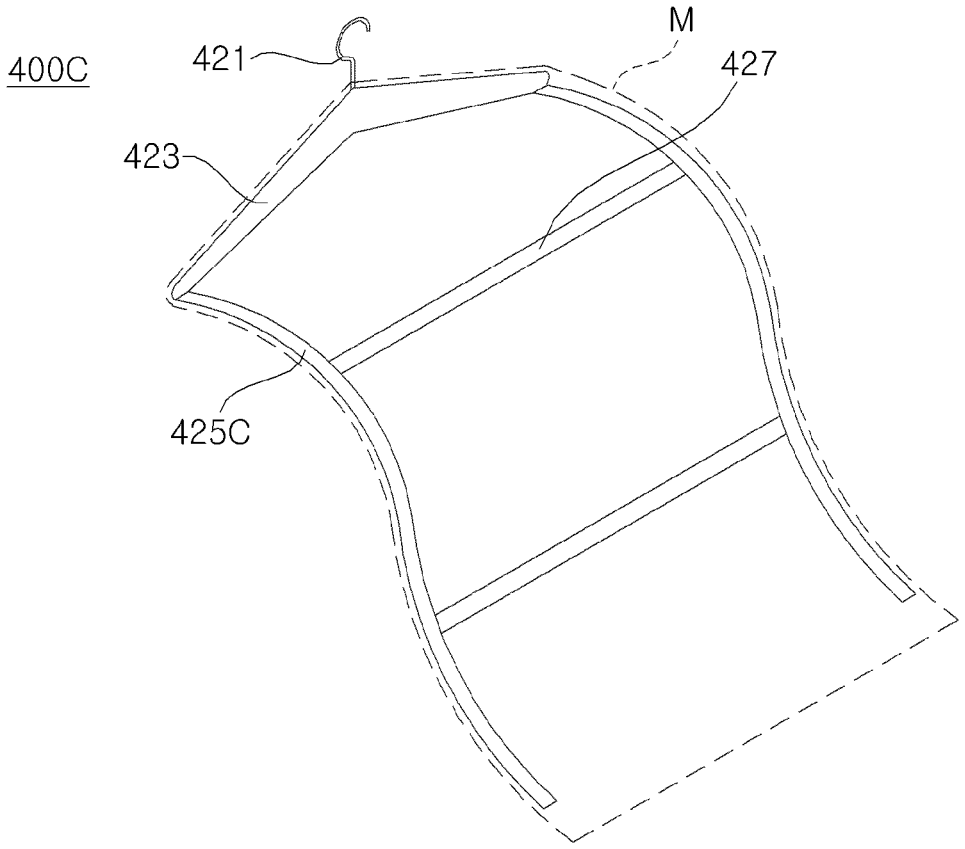

FIGS. 3A to 3C illustrate various examples of a hanger unit 400 of the present invention.

Referring to FIG. 3A, a hanger 400A according to an example may further include a lifting part 425A.

The lifting part 425A functions to prevent lower parts of clothes from being wrinkled due to insufficient length of the inner tub 3. In conjunction with wing part 423, lifting part 425A enables clothes to be hung over a plane having a predetermined surface area while being perpendicular to rotating shaft 52.

For example, lifting part 425A extends from wing part 423 to be perpendicular to the longitudinal direction of wing part 423. In other words, lifting part 425A may be positioned to be perpendicular to the longitudinal direction of wing part 423, as viewed in a plane perpendicular to rotating shaft 52. In conjunction with wing part 423, lifting part 425A defines a predetermined surface area in a plane perpendicular to the direction of gravity.

Lifting part 425A has rounded free ends that are curved downward. The rounded free ends give advantages in that deformation of clothes caused by tensile force concentrated at the free ends of lifting part 425A is prevented.

Clothes cover wing part 423 and the lifting part 425A, and thus lower ends of the clothes are lifted from the bottom of inner tub 3 by a length of a region defined by wing part 423 and lifting part 425A. Consequently, effects of reducing wrinkles generated at lower parts of clothes may be improved during a wrinkle reduction mode. Additionally, it is possible to solve the problem that wrinkles generated at lower parts of clothes are not reduced due to the interference with a bottom of inner tub 3.

Furthermore, lifting part 425A may be inclined downward with respect to a plane perpendicular to the rotating shaft 52 of the motor 51.

If lifting part 425A is positioned to be perpendicular to rotating shaft 52 or to be inclined upward, clothes hung from lifting part 425A are suspended at the free ends of lifting part 425A. At this point, tensile force is concentrated upon regions of the clothes located at the free ends of the lifting part 425A, and thus the regions of the clothes located at the free ends are deformed.

Accordingly, when lifting part 425A extends from wing part 423 to be inclined downward with respect to a plane perpendicular to the rotating shaft 52 of the motor 51, the tensile force applied to the clothes is evenly distributed over the entire area of the portions of the clothes covering the lifting part 425A.

As illustrated in FIG. 3A, lifting part 425A may have a linear shape.

Referring to FIG. 3B, a lifting part 425B according to another example may be rounded.

When lifting part 425B is rounded, the area of the portions of clothes hung from the lifting part 425B may be extended in inner tub 3 having a limited radius.

Accordingly, thanks to the rounded lifting part 425B, a length of clothes which are hung from the lifting part 425B is increased, thus lifting the lower part of the clothes from the bottom of inner tub 3. Lifting part 425B may, of course, include a plurality of lifting parts. In this case, the plurality of lifting parts 425B may be held in place by means of a retainer 427.

Referring to FIG. 3C illustrating a lifting part 425C according to a further example, the lifting part 425C may be formed to have an S-shaped cross-section as viewed in a plane parallel to rotating shaft 52.

When lifting part 425C has an S-shaped cross-section, it is possible to prevent lower parts of long clothes in a limited space of the inner tub 3 from being wrinkled due to the interference with the bottom of inner tub 3.

Hereinafter, operations of washing machines according to embodiments of the present invention will be described.

Figure 4:
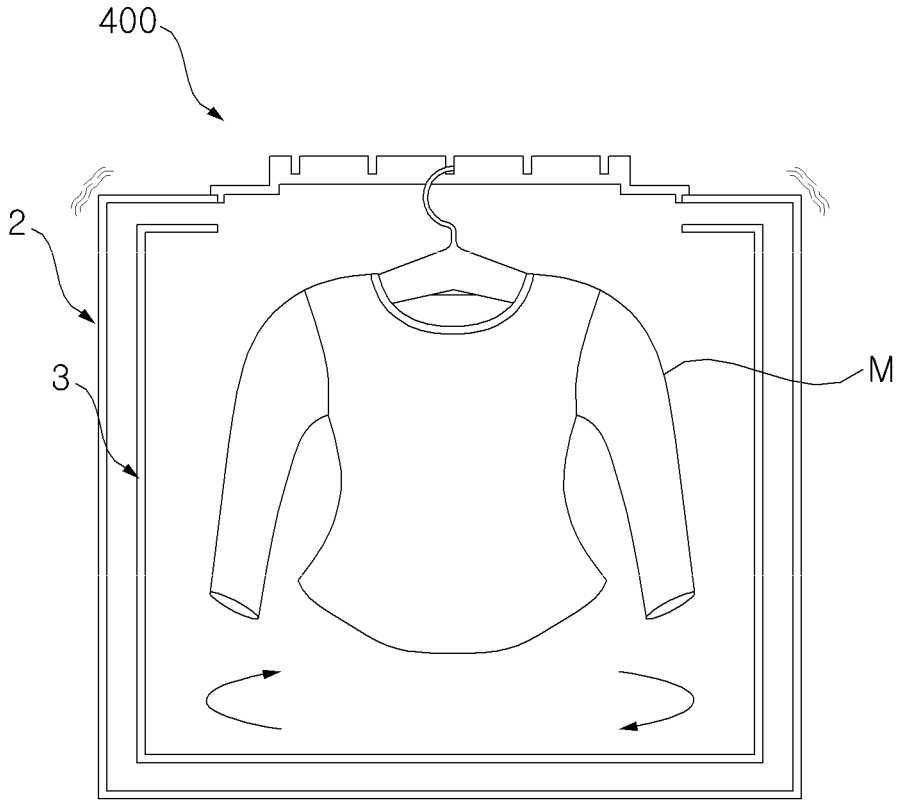
FIG. 4 is a reference diagram illustrating an operating principle of a washing machine according to a first embodiment of the present invention.

FIG. 4 illustrates an operating principle of a washing machine according to an embodiment of the present invention.

The washing machine according to this embodiment is configured to reduce wrinkles of clothes hung from the hanger unit 400 by vibration generated during rotation of the motor 51.

More specifically, hanger unit 400 is mounted on outer tub 2, and clothes are hung from the hanger unit 400. Outer tub 2 generates vibration due to rotary driving force of inner tub 3 and repulsive force generated during rotation of the inner tub 3, and this vibration reduces wrinkles of clothes hung from the hanger unit 400.

In addition, inner tub 3 may alternately rotate clockwise and counterclockwise (stirring rotation). When inner tub 3 rotates in one direction and then abruptly rotates in the opposite direction, repulsive force is maximized, and thus wrinkles of clothes hung from the hanger unit 400 may be more efficiently reduced.

In the case of clothes which have been completely washed and dehydrated, when vibration is transmitted to outer tub 2 while hot air from hot air supply unit 300 is supplied to the clothes, drying of the clothes and reduction of wrinkles of the clothes can be concurrently achieved.

Meanwhile, in the case of clothes which have been completely dried or which have not yet been subjected to a washing procedure, when vibration is transmitted to outer tub 2 while steam from steam supply unit 200 is supplied to the clothes, reduction of wrinkles by the steam and reduction of wrinkles by the vibration transmitted to outer tub 2 can be concurrently achieved.

Figure 5:
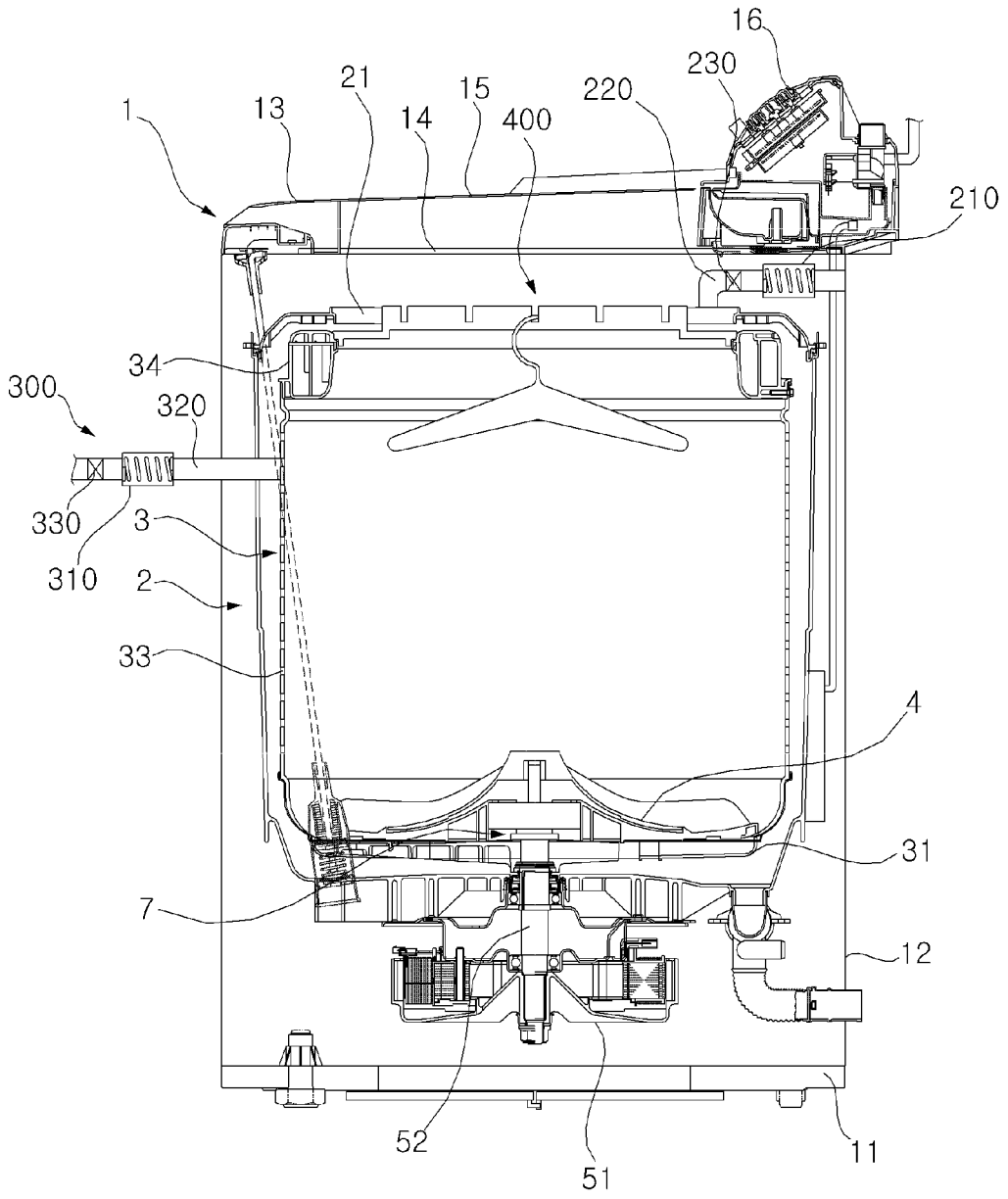
FIG. 5 is a longitudinal cross-sectional view of a washing machine according to a second embodiment of the present invention.
Figure 6:
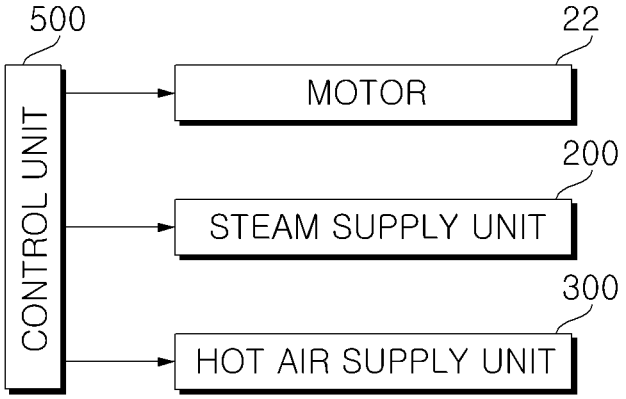
FIG. 6 is a block diagram of the washing machine according to the second embodiment of the present invention.
Figure 7:
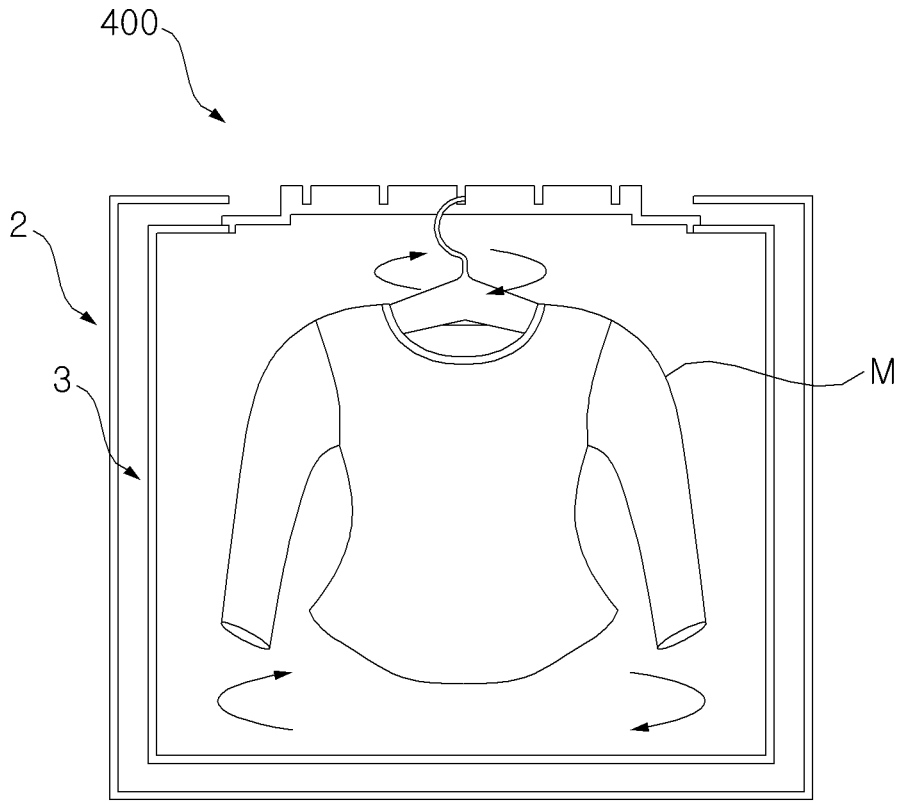
FIG. 7 is a reference diagram illustrating an operating principle of the washing machine according to the second embodiment of the present invention.

FIG. 5 is a longitudinal cross-sectional view of a washing machine according to a second embodiment of the present invention. FIG. 6 is a block diagram of the washing machine according to the second embodiment of the present invention. FIG. 7 is a reference diagram illustrating an operating principle of the washing machine according to the second embodiment of the present invention.

Referring to FIGS. 5 and 6, the washing machine according to the second embodiment includes an inner tub 3, an outer tub surrounding the inner tub 3, a motor 51 for supplying rotational force required to rotate the inner tub 3, and a hanger unit 400 detachably mounted on the inner tub 3 and from which clothes are hung.

The washing machine according to this embodiment may further include a steam supply unit 200 and/or a hot air supply unit 300.

Since the other components of this embodiment are identical to those of the first embodiment except for the hanger unit 400, a detailed description thereof will be omitted.

The washing machine according to the second embodiment differs from that of the first embodiment in that the hanger unit 400 according to the second embodiment is detachably coupled to the inner tub 3.

Hanger unit 400 may be detachably coupled to the inner tub 3. Specifically, hanger unit 400 may be detachably coupled to an upper end of the inner tub 3.

For example, hanger unit 400 may include the supporter 410 and the hanger 420. Hanger 420 is identical to the hanger described in the first embodiment.

Supporter 410 is detachably coupled to the upper end of the inner tub 3 to support hanger 420.

Hanger unit 400 may rotate along with inner tub 3 upon rotation of inner tub 3. In particular, hanger unit 400 is adapted to rotate along with clothes hung thereon upon rotation of inner tub 3.

The washing machine according to the second embodiment may further include a control unit 500.

When a user selects one of washing courses through a control panel 16, control unit 500 determines, in accordance with the selected washing course, whether to progress each cycle, or determines whether to perform operations in each cycle, such as washing, rinsing, water discharge, and drying, and times and the numbers of iterations of the operations, and performs the operations.

Control unit 500 may control motor 51 and/or the clutch to control rotation of inner tub 3. In particular, when a driving signal generated from control unit 500 is applied to motor 51, inner tub 3 may rotate continuously or intermittently in a forward direction or in the opposite direction, and may rotate at various RPMs.

Furthermore, control unit 500 may control hot air supply unit 300 so as to supply hot air to clothes received in inner unit 3.

In addition, control unit 500 may control steam supply unit 200 so as to supply steam to clothes received in inner tub 3.

FIG. 7 is a reference view illustrating an operating principle of the washing machine according to the second embodiment of the present invention.

Referring to FIG. 7, the washing machine according to the embodiment is intended to reduce wrinkles of clothes by centrifugal force caused by rotation of motor 51 and thus rotation of hanger unit 400.

More specifically, hanger unit 400 is coupled to inner tub 3, and clothes are hung from hanger unit 400. As motor 51 rotates, inner tub 3 rotates thus causing rotation of hanger unit 400. The rotation of hanger unit 400 causes rotation of the clothes hung from hanger unit 400.

The rotation of hanger unit 400 applies centrifugal force to the clothes and, as such, wrinkles of the clothes hung from hanger unit 400 are reduced by the centrifugal force.

More specifically, inner tub 3 may rotate clockwise (in a forward direction) and counterclockwise (in the opposite direction) in an alternating manner. When inner tub 3 rotates in one direction and then abruptly rotates in the opposite direction, centrifugal force and repulsive force of inner tub 3 are maximized, thus assuring more efficient reduction of wrinkles of clothes hung from hanger unit 400.

In the case of clothes which have been completely washed and dehydrated in the washing machine, when inner tub 3 rotates while hot air is supplied from the hot air supply unit 300, drying of the clothes and reduction of wrinkles of the clothes can be concurrently implemented.

In the case of clothes which have been completely dried or have not been to subjected to washing, when inner tub 3 rotates while steam is supplied to the clothes from steam supply unit 200, reduction of wrinkles of the clothes by the steam and reduction of wrinkles of the clothes by vibration of outer tub 2 can be concurrently implemented.

In the case where inner tub 3 cannot fully accommodate the entire length of the clothes, lower parts of the clothes are wrinkled due to contact with the bottom of inner tub 3. At this point, when a rotational speed of inner tub 3 is increased such that lower parts of the clothes hung from hanger unit 400 are lifted from the bottom of inner tub 3, the wrinkles of the lower parts of the clothes can be efficiently reduced.

Figure 8:
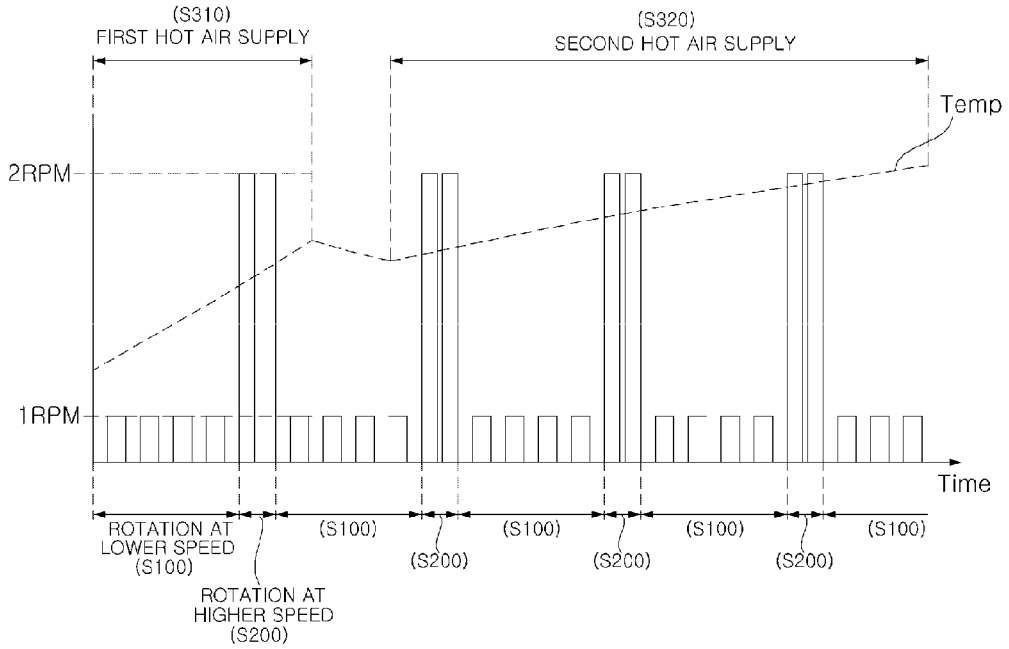
FIG. 8 is a process flow diagram illustrating a method of controlling the washing machine according to the first embodiment of the present invention.

FIG. 8 is a process flow diagram illustrating a method of controlling the washing machine according to the first embodiment of the present invention.

Referring to FIG. 8, according to this embodiment, the method of controlling the washing machine including the inner tub 3 accommodating clothes, the outer tub 2 surrounding the inner tub 3, the motor 51 for supplying rotational force required to rotate the inner tub 3, and the hanger unit 400 detachably coupled to the inner tub 3 and from which the clothes are hung, may include hanging the clothes on hanger unit 400 coupled to inner tub 3, rotating inner tub 3 at a first lower rotational speed (S100), and rotating inner tub 3 at a second rotational speed higher than the first rotational speed (S200).

In the hanging of the clothes, the clothes are hung from hanger unit 400 coupled to inner tub 3. At this point, the clothes are preferably hung from hanger unit 400 such that the clothes are spread over the length of wing part 423.

In rotation of inner tub 3 at the lower rotational speed (S100), inner tub 3 rotates at a first rotational speed ($RPM_1$). More specifically, control unit 500 outputs a control signal, and, in response to the control signal, the driving unit outputs a driving signal for driving motor 51. Motor 51 is then controlled by the driving signal, thus controlling rotation of inner tub 3.

The first rotational speed ($RPM_1$) may be in a range of 18 to 25 RPM. This first rotational speed contributes to a primary disentangling of clothes in the rotation of inner tub 3 at the lower rotational speed (S100).

For example, in the rotation of inner tub 3 at the lower rotational speed (S100), inner tub 3 may perform rotation in a forward direction at the first rotational speed, rotation in the opposite direction at the first rotational speed, or repeated rotation in the forward and the opposite directions. Furthermore, in the rotation of inner tub 3 at the first rotational speed (S100), inner tub 3 may rotate continuously or intermittently at the first rotational speed.

In particular, the rotation of inner tub 3 in a forward direction and then in the opposite direction is useful to disentangle entangled clothes.

In the rotation of inner tub 3 at the higher rotational speed (S200), inner tub 3 rotates at the second rotational speed ($RPM_2$) higher than that in the rotation at the lower rotational speed (S100).

In the rotation of inner tub 3 at the higher rotational speed (S200), inner tub 3 rotates at a predetermined rotational speed or higher so as to provide intensive centrifugal force to the clothes hung from hanger unit 400. At this point, the entangled clothes, which have been primarily disentangled in the rotation of inner tub 3 at the lower rotational speed (S100), are further disentangled by virtue of the intensive centrifugal force.

When the clothes have a long length relative to a depth of inner tub 3, the clothes come into contact with the bottom of inner tub 3. If the clothes are in contact with the bottom of inner tub 3, wrinkles generated at lower parts of the clothes are not easily reduced even though the clothes are rotated.

Accordingly, in the rotation of inner tub 3 at the higher rotational speed (S200), inner tub 3 rotates at such a rotational speed as to lift the lower parts of the clothes from the bottom of inner tub 3, thus easily reducing wrinkles of the lower parts of the clothes.

More specifically, in the rotation of inner tub 3 at the higher rotational speed (S200), the second rotational speed, $RPM_2$, is preferably in a range of 100 to 140 RPM. If the second rotational speed is lower than 100 RPM, lifting force for the clothes is decreased, thus making it impossible to expect sufficient reduction of wrinkles of the lower parts of the clothes owing to the decrease of the lifting force. If the second rotational speed is higher than 140 RPM, although the lifting force is increased, excessive centrifugal force is applied to the clothes, thus causing permanent deformation of the clothes and overload of motor 51.

For example, in the rotation of inner tub 3 at the higher rotational speed (S200), inner tub 3 may perform rotation in a forward direction at the second rotational speed, rotation in the opposite direction at the second rotational speed, or repeated rotation in the forward direction and the opposite direction. Furthermore, in the rotation of inner tub 3 at the higher rotational speed (S200), inner tub 3 may rotate continuously or intermittently at the second rotational speed.

In this regard, duration of the rotation of inner tub 3 at the lower rotational speed (S100) and duration of the rotation of inner tub 3 at the higher rotational speed (S200) may be set in consideration of the kind of the clothes. In most cases, the duration of the rotation of inner tub 3 at the lower rotational speed (S100) is preferably longer than the duration of the rotation of inner tub 3 at the higher rotational speed (S200).

Furthermore, the rotation of inner tub 3 at the lower rotational speed (S100) and the rotation of inner tub 3 at the higher rotational speed (S200) may be alternately repeated at predetermined intervals of time. Of course, the rate of rotation of inner tub 3 at the lower rotational speed (S100) and the rate of rotation of inner tub 3 at the higher rotational speed (S200) may be differently set depending upon the kind of the clothes.

The method of controlling the washing machine according to this embodiment may further include supplying hot air to inner tub 3.

In the supply of hot air, hot air is supplied to the inside of inner tub 3 to dry the clothes. Control unit 500 outputs control signals to control ON/OFF of air heater 310 and blower fan 330 of hot air supply unit 300, thus controlling temperature and supply of hot air.

In the case of clothes which have been completely washed and dehydrated in the washing machine, when inner tub 2 rotates while hot air is supplied from hot air supply unit 300, drying of the clothes and reduction of wrinkles can be concurrently implemented.

Although the supply of hot air may continue during both the rotation at the lower rotational speed (S100) and the rotation at the higher rotational speed (S200), it may continue during at least the rotation at the lower rotational speed (S100).

In particular, since it is difficult to supply hot air into the clothes due to vortex flow in inner tub 3 during rotation at the higher rotational speed (S200), the supply of hot air preferably continues during rotation at the lower rotational speed (S100).

For example, the supply of hot air may include a first supply of hot air (S310), and a second supply of hot air (S320) which is executed after the lapse of a predetermined period of time after the first supply of hot air (S310). Because of relatively low thermal conductivity of air, temperature of the air does not greatly decrease even though a certain period of time elapses after air is heated to a predetermined temperature.

Accordingly, the second supply of hot air (S320) begins after the lapse of a predetermined period of time after the first supply of hot air (S310). Specifically, in the first supply of hot air (S310), control unit 500 operates hot air supply unit 300 for a predetermined period of time for which sufficient hot air is supplied to the inner tub 3 for the purpose of reducing energy consumption. Thereafter, when the temperature in the inner tub 3 reaches a predetermined temperature (for example, 100 degrees), the control unit 500 turns off the hot air supply unit 300. After lapse of a predetermined period of time, control unit 500 operates hot air supply unit 300 again to initiate the second supply of hot air (S320).

Figure 9:
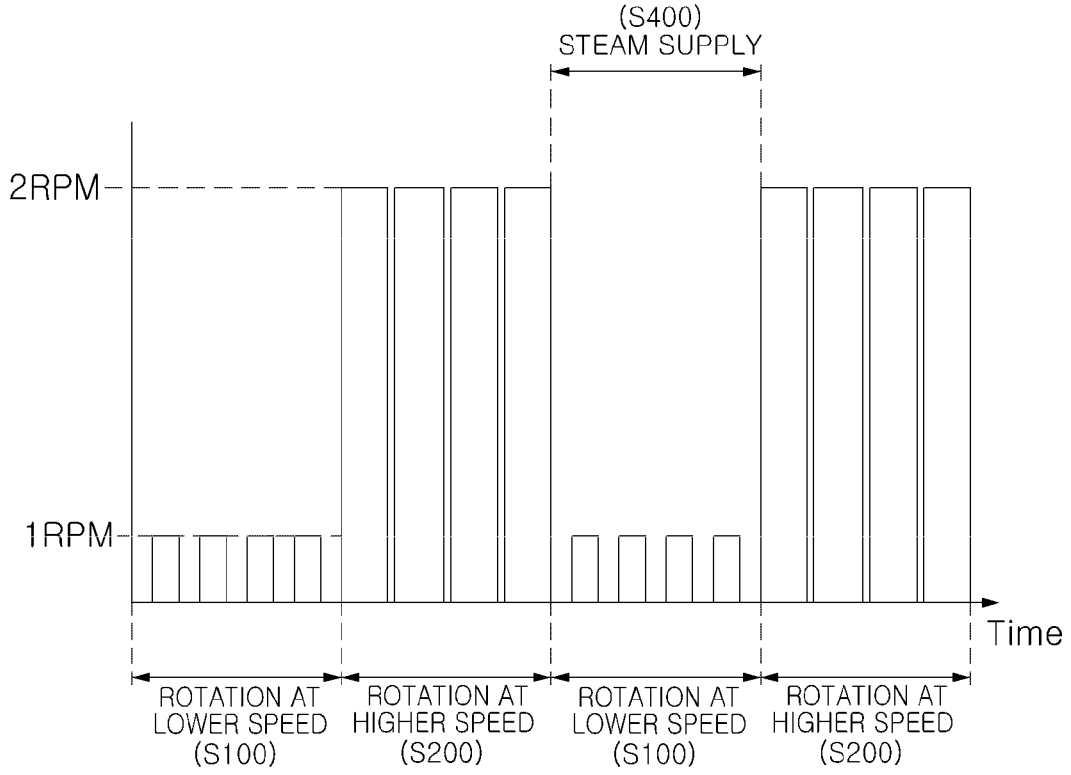
FIG. 9 is a process flow diagram illustrating a method of controlling the washing machine according to the second embodiment of the present invention.

FIG. 9 is a process flow diagram illustrating a method of controlling the washing machine according to the second embodiment of the present invention.

Referring to FIG. 9, according to the second embodiment, the method of controlling the washing machine including the inner tub 3 accommodating clothes, the outer tub 2 surrounding the inner tub 3, the motor 51 for supplying rotational force required to rotate the inner tub 3, and the hanger unit 400 detachably coupled to the inner tub 3 and from which the clothes are hung, may include hanging the clothes on hanger unit 400 coupled to inner tub 3, rotating inner tub 3 at a first lower rotational speed (S100), rotating inner tub 3 at a second rotational speed higher than the lower rotational speed (S200), and supplying steam (S400).

Unless otherwise indicated, the hanging of the clothes, the rotation at the lower rotational speed (S100) and the rotation at the higher rotational speed (S200) are substantially identical to those described in the method according to the first embodiment.

In the supply of steam (S400), steam is supplied to the inside of inner tub 3 to reduce wrinkles of clothes. Control unit 500 outputs control signals to control ON/OFF of steam heater 210 and valve 230 of steam supply unit 200, thus controlling supply of steam and a supply amount of steam.

In the case of clothes which have been completely dried or have not been subjected to washing, when inner tub 3 rotates while steam is supplied to the clothes from steam supply unit 200, reduction of wrinkles of the clothes by the steam and reduction of wrinkles of the clothes by rotation of inner tub 3 can be concurrently implemented.

Although the supply of steam may continue during both rotation at the lower rotational speed (S100) and rotation at the higher rotational speed (S200), it may continue during at least the rotation at the lower rotational speed (S100).

In particular, since it is difficult to supply steam to the clothes due to vortex flow in inner tub 3 during rotation at the higher rotational speed (S200), it is preferable that the supply of steam continues during rotation of the lower rotational speed (S100). For efficient supply of steam to the clothes, inner tub 3 preferably performs stirring rotation in which a forward rotation and the opposite rotation of inner tub 3 are repeated in the rotation at the lower rotational speed (S100).

Specifically, in order to achieve both an effect on the reduction of wrinkles by steam and an effect on the reduction of wrinkles by centrifugal force, rotation at the higher rotational speed (S200) is preferably performed at least before or after the supply of steam (S400).

It should be noted that effects of the present invention are not limited to the effects of the present invention as mentioned above, and other unmentioned effects of the present invention will be clearly understood by those skilled in the art from the following claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings, and the appended claims. In addition to variations and modifications in the component parts and/or arrangements, alternative uses will also be apparent to those skilled in the art.

What is claimed is:

1. A washing machine comprising:
an inner tub for receiving clothes;
an outer tub accommodating the inner tub;
a motor for supplying rotational force to rotate the inner tub; and
a hanger unit detachably coupled to an upper end of the outer tub,
wherein the clothes are hung from the hanger unit, and
whereby wrinkles of the clothes hung from the hanger unit are reduced by virtue of vibration generated during rotation of the motor,
wherein the hanger unit comprises:
a supporter detachably inserted in coupling holes formed at the upper end of the outer tub,
wherein a length of the supporter bridges an opening of the outer tub; and
a hanger hung from the supporter so as to allow the clothes hung from the hanger to be received in the inner tub,
wherein the supporter comprises:
a center section having at least one groove, perpendicular to the length of the supporter, in which the hanger is hung; and
coupling sections connected to the opposite ends of the center section and inserted in the coupling holes,
wherein an upper surface of the center section protrudes higher than upper surfaces of the coupling sections,
wherein the upper surface of the center section is positioned higher than the upper end of the outer tub, and
wherein the hanger comprises:
a hanging part hung from the center section;
a wing part from which the clothes are hung; and
a lifting part perpendicularly connected to the wing part and extending therefrom.

2. The washing machine of claim 1, further comprising:
a steam supply unit for supplying steam to the inner tub; and
a hot air supply unit for supplying hot air to the inner tub.

3. The washing machine of claim 2, wherein the inner tub alternately rotates clockwise and counterclockwise.

4. The washing machine of claim 3, wherein the lifting part has a curved end.

5. The washing machine of claim 3, wherein the lifting part extends from the wing part to be inclined downward with respect to a plane perpendicular to a rotating shaft of the motor.

6. The washing machine of claim 5, wherein the lifting part is rounded.

* * * * *